United States Patent [19]

Marthaler

[11] 4,046,566

[45] Sept. 6, 1977

[54] PROCESS FOR THE PRODUCTION OF MASKED POSITIVE COLOR IMAGES BY THE SILVER DYE BLEACH PROCESS USING SILVER COMPLEX DIFFUSION

[75] Inventor: Max Marthaler, Marly, Switzerland

[73] Assignee: Ciba-Geigy AG, Basel, Switzerland

[21] Appl. No.: 625,235

[22] Filed: Oct. 23, 1975

[30] Foreign Application Priority Data

Oct. 28, 1974 Switzerland ..... 14401/74

[51] Int. Cl.[2] ..... G03C 7/04; G03C 1/76; G03C 3/00

[52] U.S. Cl. ..... 96/7; 96/5; 96/6; 96/68; 96/74

[58] Field of Search ..... 96/7, 10, 68, 77, 3, 96/73, 5, 6, 8, 74

[56] References Cited

U.S. PATENT DOCUMENTS

| | | | |
|---|---|---|---|
| 2,183,395 | 12/1939 | Gaspar | 96/73 |
| 2,376,217 | 5/1945 | Wilder | 96/7 |
| 2,393,756 | 1/1946 | Dearing | 96/7 |
| 2,694,008 | 11/1954 | Berger et al. | 96/3 |
| 3,148,062 | 9/1964 | Whitmore et al. | 96/3 |
| 3,227,551 | 1/1966 | Barr et al. | 96/77 |
| 3,647,436 | 3/1972 | Bush | 96/77 |
| 3,764,331 | 10/1973 | Ohyama et al. | 96/73 |

*Primary Examiner*—David Klein

*Assistant Examiner*—Louis Falasco

*Attorney, Agent, or Firm*—Burgess, Dinklage & Sprung

[57] ABSTRACT

The present invention relates to a process for the production of masked subtractive positive color images in accordance with the silver dye bleach process. In the material to be processed a. a silver halide emulsion layer consisting at least partially of silver iodide is allocated to the dyestuff, of which the undesired parasitic color density is to be compensated, b. in a further layer, at least one second dyestuff, of which the main color density corresponds to a parasitic color density, requiring compensation, of the first dyestuff, and a silver halide emulsion free from iodide ions, are present, c. a further layer, which is adjacent to that containing the second dyestuff, contains colloidal nuclei which are capable of depositing metallic silver from soluble silver complexes, d. a separating layer is present between the layer containing the nuclei and the dyestuff layer, of which the parasitic color density is to be compensated.

The silver developer bath, with which the material is treated contains a ligand, which is able to produce water-soluble silver complexes which are capable of diffusion.

14 Claims, 5 Drawing Figures

TABLE

LEGEND

Y : Yellow
M : Magenta
BG: Cyan
MC: Masked colour(s)
$C_1, C_2, C_3$: colour layers
T : top layer PCD: parasitic colour density
R : red
G : green
B : blue
sensitisation or absorption region
N : nuclei layer
$I^{\ominus}$; ▼ : layer with (▽ without) AgI
S : separating layer

| | 1 | 2 | 3 | 4 | 5 | 6 |
|---|---|---|---|---|---|---|
| | Y | Y | M | M | BG | BG |
| | M | BG | Y | BG | Y | M |
| | BG | M | BG | Y | M | Y |
| MC | BG+M | | Y+BG | | Y+M | |
| PCD | B | | G | | R | |

| | 19 | 20 | 21 | 22 | 23 | 24 |
|---|---|---|---|---|---|---|
| | Y | Y | M | M | BG | BG |
| | M | BG | Y | BG | Y | M |
| | BG | M | BG | Y | M | Y |
| MC | Y | | M | | BG | |
| PCD | G+R | | B+R | | B+G | |

TABLE

COLOUR DENSITY
3
2
1
0,1
0
Y(b+g+r)
Y(b)
+0,44
3
2
1
0
log.E

COLOUR DENSITY
3
2
1
0
Y(g)
M(g)
3
2
1
0
log.E

COLOUR DENSITY
3
2
1
0
Y(r)
BG(r)
3
2
1
0
log.E

PROCESS FOR THE PRODUCTION OF MASKED POSITIVE COLOR IMAGES BY THE SILVER DYE BLEACH PROCESS USING SILVER COMPLEX DIFFUSION

In the present description some technical terms are used, which, for unequivocal understanding are defined as follows.

Primary Colours: The three colours red, green and blue, which in appropriate amounts result in pure white.

Main Colours: Substrative colours obtained by subtracting one of the primary colours from pure white.

Cyan: White minus red

Magenta: White minus green

Yellow: White minus blue

The main colours are complementary to the primary colours with which they result in white.

Main colour density: Spectral region, where the main colours absorb most of the transmitted or reflected light. This region corresponds to the complementary primary colour.

Parasitic colour density: Spectral region, where any dyestuff used as main colour absorbs light and which lies outside the region of the complementary primary colour.

Masking: Countermeasure to compensate for colour shift caused by parasitic colour densities of one or more of the dyestuffs used in a photographic material.

Photographic processes for the production of coloured images, or for the reproduction of coloured originals, work almost exclusively on the substractive principle. In that case, in general, three superposed layers are used on a transparent or opaque carrier, each of the layers containing a partial image in the subtractive main colours cyan, magenta and yellow. In this way it is possible to reproduce all colour shades lying within the colour range defined by the three main colours. By suitable choice of the image dyestuffs it is in this way possible satisfactorily to reproduce, in respect of tonal value and saturation, the colours occurring in nature or in the original. A prerequisite for this is a favourable mutual balance within the set of three dyestuffs and a high saturation of the individual main colours.

However, under practical conditions a difficulty is encountered which cannot be overcome easily with simple photographic means. This is that the dyestuffs which are available for reproduction of the three main colours cyan, magenta and yellow all exhibit, in addition to the desired absorption in one of the three complementary primary colours red, green or blue, at least one further, through weaker, absorption range in a spectral range corresponding to the two other main colours. This so-called parasitic colour density in itself does not prevent the reproduction of all colour values and depth values occurring within the colour range; however, it has as the consequence that a change of colour density within a colour layer, such as can be achieved, in accordance with known photographic processes, with the aid of a correspondingly sensitised silver halide emulsion, affects both the principal colour density and the parasitic colour density. This results in undesired colour shifts and saturation losses which very considerably interfere with the faithfulness of the colour when reproducing an original.

In principle, parasitic colour densities are encountered with all three subtractive main colours. In the case of yellow (main absorption in the blue), they are in the red and green, in the case of magenta (main absorption in the green) they are in the red and blue and in the case of cyan (main absorption in the red) they are in the green and blue. The particularly intense, and therefore objectionable, parasitic colour densities are those of the magenta dyestuffs in the blue and red and those of the cyan dyestuff in the blue. The parasitic colour density of the cyan dyestuff in the green is somewhat less objectionable, and those of the yellow dyestuff in the red and green even less so. The consequence of this is that, above all, the reproduction of pure blue and red shades constantly presents difficulties in photographic colour materials.

There has been no lack of attempts to overcome, or at least reduce, in various ways, these fundamental shortcomings of the photographic colour materials. Since hitherto it has not been possible to discover any cyan, magenta and yellow dyestuffs without objectionable parasitic colour densities, the objective had to be achieved by indirect means. One of the processes known as masking is based on the principle that the undesired parasitic colour density of a dyestuff is compensated in additional layers having a contrary gradation so that, independently of the particular main colour density, the sum of the parasitic colour densities in the layer to be masked and in the masking layer remains constant. However, if used logically for all six parasitic colour densities, this process has the consequence that pure white shades (= absence of any colour density) are no longer achievable, and at best neutral grey shades can be achieved. The process is therefore above all suitable for the production of colour negatives or in reproduction processes, production of colour separations and the like, that is to say in processes in which the said disadvantage can again be compensated in the subsequent copying or reproduction stage.

The masking processes have found broad acceptance in the field of colour photography by chromogenic processes (colour development processes). In these, various effects are utilised for masking. Thus, for example, the residual silver remaining after developing can be used to form a masking image with contrary gradation as described in German Pat. Nos. 743,535 and 898,709 or in Swiss Pat. No. 271,389. Other patent specifications such as, say German Pat. No. 950,617 or British Patent Specifications Nos. 665,657, 714,012 and 1,210,893, describe the production of a masking image by chemical conversion of the residual unconsumed colour-coupling agent left from colour developing. A further method described, for example, in German Pat. Nos. 1,643,980 and 2,185,220 or Belgian Pat. No. 675,259, relates to the use of colour coupling agents of which the intrinsic colour corresponds to the parasitic colour density, which is to be compensated, of the dyestuff developed therefrom (self-masking). Other processes depend on the bleaching of azo dyestuffs by the image silver produced during colour development; such processes are described, for example, in French Pat. No. 1,414,803 or in East German Pat. No. 8,051. Colour images having opposite gradation can also be obtained in separate layers using direct positive emulsions, as described in French Pat. No. 904,964 or in East German Pat. No. 8,051, or by the silver dye bleach process, according to U.S. Pat. No. 2,336,380.

Further proposals relate, for example, to the bleaching of azo dyestuffs by the oxidised colour developer (German Auslegeschrift No. 1,150,275), controlled diffusion of a bleaching bath (U.S. Pat. No. 2,763,150), utilisation of silver complex diffusion (German Auslegeschrift No. 1,008,117) and the like. Finally, masking effects can be achieved also by false sensitisation of individual emulsions, as described in British Patent Specification No. 685,610.

Masked colour images which are used for the production of colour copies or are used as colour separations for the production of printing plates for reproduction, can also be obtained by taking up the compensating colour images on separate carriers and bringing the latter into register with the original prior to the copying process. Such processes are described, for example, in German Pat. Nos. 975,867, 976,138, 976,904 and 965,615 and in German Auslegeschrift 1,142,757, as well as in British Patent Specifications No. 903,050.

Masking processes have also been disclosed in the production of subtractive positive images by the silver dye bleach process. Thus, for example, U.S. Pat. No. 2,387,754 has disclosed the combination of layers with negatively working emulsions and layers which contain a directly positively working emulsion. In that case, component images of the desired colour but of opposite gradation are produced during development and dye bleaching. U.S. Pat. No. 2,193,931 describes the combination of positive silver dye bleach images with negative mordanted images produced from the image silver. Swiss Pat. No. 209,656 describes the production of masking images by the silver dye bleach process, wherein emulsions with particularly flat gradation are used for the masking layer. Finally, British Patent Specification No. 523,179 has disclosed a process in which, in one and the same layer, a positive image is produced by the silver dye bleach process and at the same time a negative image is produced in another colour, whereby for example, the dyestuff of the first image, which provides the positive image after bleaching, provides the negative image of the second colour.

The processes described in these patents are suitable for the production of colour separations, for example for reproduction purposes. However, because of the residual colour density which remains even in the image areas which should become white, the processes are not suitable for the direct production of positive reproductions of a coloured original. For this purpose, only a partial masking in which light absorption no longer takes place in the image areas which have remained white, is acceptable. Surprisingly, the silver dye bleach process, in which all layers have a colour gradation in the same sense as the original, is suitable for such partial masking if steps are taken so that during exposure a sensitivity shift in the individual component ranges of the layers takes place, in the sense that the desired masking effect results.

U.S. Pat. No. 2,673,800 has shown that the known process of silver complex diffusion can be used for the production of negative images in accordance with the silver dye bleach process. Surprisingly, the effect described there can now be utilised, by additional measures, for masking images by the silver dye bleach process. By a suitable arrangement of the layers and by choice of the composition of the emulsions corresponding to the individual image dyestuffs it is possible, according to the present invention, to ensure that after exposure in the individual component regions, a sensitivity shift of the layers takes place, in the sense that the desired masking effect is achieved.

This is due to the fact that it has been found that subtractive positive colour images can be produced, with a particularly good masking effect, in accordance with the silver dye bleach process, by exposure, silver development, dye bleaching, silver bleaching and fixing, and using a photographic material which contains, in each of at least two layers, a dyestuff which can be bleached imagewise, and of which the absorption maximum corresponds to one of the primary colours red, green and blue, with a silver halide emulsion layer sensitive to a particular spectral region being allocated to each dyestuff, if, in this material, a. a silver halide emulsion layer consisting at least partially of silver iodide is allocated to the dyestuff, of which the undesired parasitic colour density is to be compensated, b. in a further layer, at least one second dyestuff, of which the main colour density corresponds to a parasitic colour density, requiring compensation, of the first dyestuff, and a silver halide emulsion free from iodide ions are present, c. a further layer, which is adjacent to the layer containing the second dyestuff, contains colloidal nuclei which are capable of depositing metallic silver from soluble silver complexes, d. a separating layer is present between the layer containing the nuclei and the dyestuff layer, of which the parasitic colour density is to be compensated, and if the silver developing bath, with which the material is treated, contains a ligand, which is able to produce water-soluble silver complexes which are capable of diffusion.

By a substance which is allocated to another there are here to be understood substances which belong to the same layer of a photographic material or belong to two adjacent layers and which can interact.

Figure 1:
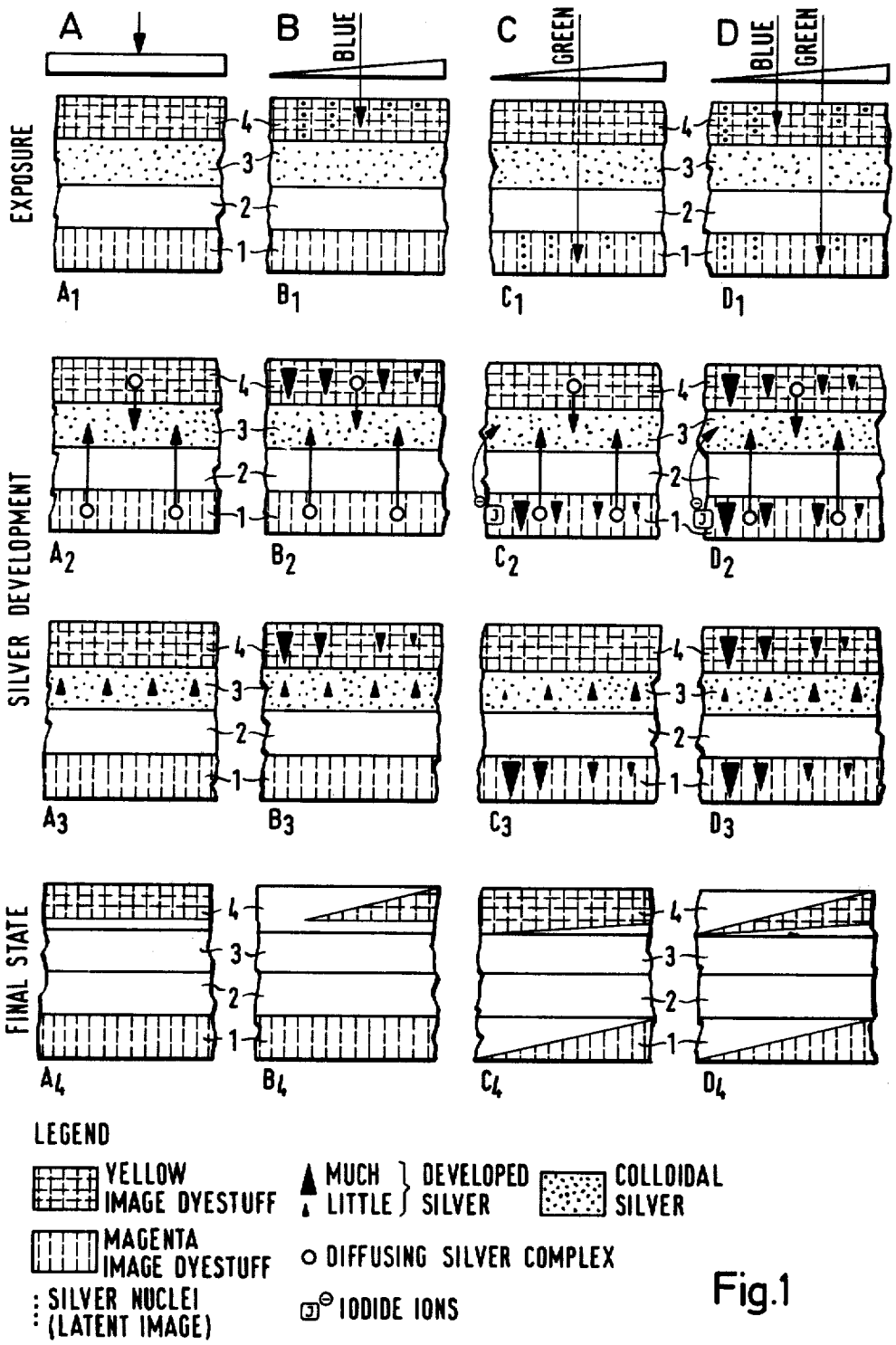
FIG. 1 illustrates what takes place during processing under (various) filtering conditions.

The phenomena which take place during processing, given the above preconditions, will be explained below in relation to an example with two image dyestuffs (compare FIG. 1).

A material is used which consists of the following layers, in the sequence from bottom to top, on an opaque carrier:

1. A layer with a magenta dyestuff and a silver bromide emulsion, containing iodide, sensitised to green.
2. A gelatine layer containing neither emulsion nor dyestuff.
3. A layer with a small proportion of colloidal silver.
4. A yellow dyestuff layer containing a non-sensitised, iodide-free, silver bromide emulsion sensitive to blue.
5. A protective layer (not shown in the figure) which contains neither emulsion nor dyestuff.

If now such a material is exposed behind the grey wedge and subsequently developed, and finally processed, in the manner described, with addition of a ligand which forms soluble complexes, the following phenomena occur:

A. unexposed areas (maximum density of the copying wedge).

As a result of the silver solvent in the developer, a diffusible complex ($A_2$) is produced from the silver halide of the emulsions and is deposited in the nucleus layer (colloidal silver) as metallic silver ($A_3$). During the subsequent colour bleaching, the yellow layer is partially bleached from below by remote bleaching ($A_4$). The magenta layer is protected against remote bleaching by the gelatine intermediate layer.

B. on exposure to blue light

The blue-sensitive emulsion in the yellow layer contains a latent image $B_1$. The green-sensitive emulsion in the magenta layer remains unexposed, since the blue spectral component of the copying light is sufficiently attenuated by the yellow dyestuff and the yellow colloidal silver ($B_1$). On development, the latent image in the yellow layer is developed to give metallic silver ($B_2$); no silver development takes place in the magenta layer. At the same time, diffusible complexes ($B_2$) are formed from the excess silver halide of the yellow layer and from the silver halide of the magenta layer and these complexes are reduced in the nucleus layer to metallic silver ($B_3$). The amount of this silver in the nucleus layer is only insignificantly dependent on the blue exposure, since a sufficient quantity of silver halide is available for complex formation and on development no iodide ions which prevent the physical development on the nuclei are formed.

During the subsequent dye bleaching, the yellow dyestuff is bleached by the silver image developed in the layer. In addition, a substantially constant proportion of yellow dyestuff is bleached away by remote action from the nucleus layer ($B_4$). After processing, less dyestuff therefore remains in the yellow layer, that is to say the yellow layer is apparently more sensitive than if no physical development had taken place in the nucleus layer.

C. on exposure to green light

The blue-sensitive layer remains unexposed; a latent image ($C_1$) is produced in the green-sensitive layer. On development soluble silver complexes again form, above all from the emulsion of the yellow layer, and migrate to the layer containing the nuclei ($C_2$). At the same time, however, the green-sensitive emulsion, which contains iodide, is developed ($C_2$). On reduction of the silver halide, iodide ions are liberated, which migrate into the layer containing the nuclei and there prevent the physical development of the dissolved silver complexes ($C_2$). Accordingly, a silver image controlled by the green exposure is produced in the nucleus layer, and this image is of opposite gradation to the silver image developed in the green-sensitive emulsion ($C_3$).

During the subsequent dye bleaching, the magenta dyestuff is degraded proportionately to the silver developed in this layer. The yellow layer is partially bleached by remote action from the silver image of the nucleus layer. After the final processing, a yellow image remains in the yellow layer, its density being dependent on the green exposure ($C_4$). The yellow density increases with increasing green exposure and decreasing magenta density.

D. exposure with blue and green (or white) light

A latent image ($D_1$) is produced both in the blue-sensitive yellow layer and in the green-sensitive magenta layer. On development, the same silver image as in (B) is developed in the yellow layer, and the silver image according to (C) is developed in the magenta layer ($D_3$). In the nucleus layer, as under (C), a silver image which is of opposite gradation to that of the magenta layer is produced ($D_3$).

During dye bleaching, the same colour image as on green exposure along (C) is produced in the magenta layer. In the yellow layer, on the other hand, whilst the silver developed in the lyer itself produces a dye bleaching (analogously to B), the additional bleaching from the nucleus layer becomes less with increasing green exposure ($D_4$).

Accordingly, more dyestuff remains in the yellow layer than if a green exposure had not been used. This means that the yellow layer is in effect less sensitive if it is not exposed with blue alone, but with both blue and green.

Overall, therefore, the following picture results: under exposure conditions under which the green-sensitive layer is not exposed, that is to say if a large amount of magenta dyestuff remains, a certain proportion of yellow dyestuff is bleached away. This corresponds to a compensation of the blue parasitic colour density of the magenta dyestuff. The difference in sensitivity of the yellow layer on blue exposure alone (higher sensitivity, B) and on blue and green exposure (lower sensitivity, D) is to be regarded as a measure of the desired masking effect. The combination of the layer containing nuclei with a separating layer ensures that the silver deposited in the nucleus layer can act in the desired direction only.

It is easily seen that a series of different masking effects can be achieved in accordance with the process described. Depending on the arrangement of the layers in the total assembly of layers it is possible to mask one or two parasitic colour densities of a dyestuff or one parasitic colour density of two dyestuffs. The table (FIG. 2) shows a selection of the different possible layer arrangements and combinations which lead to different masking effects. In addition, further possibilities, not shown in the table, are conceivable, for example those in which two iodide-free emulsion layers and one emulsion layer containing iodide are combined with only one nucleus layer so that of each colour layer only one parasitic colour density is compensated.

The schematic representation of the arrangement of layers only shows the general case in which the dyestuff and the corresponding emulsion sensitised in the colour complementary to the main colour are present in the same layer. Of course, these components allocated to one another can also be distributed over two or even three different mutually adjacent layers. Such arrangements of layers have been described, for example, in German Offenlegungschriften Nos. 2,036,918; 2,132,835 and 2,132,836. They serve, above all, to influence the relatively steep gradation of silver dye bleach materials, or also to increase the sensitivity. As is already emphasized by the above circumscription of the material there is a limitation as regards the layer which contains the dyestuff of which the main colour density corresponds to a parasitic colour density to be masked, the iodide-free silver halide emulsion which belongs to this dyestuff must be present in the layer itself, that is to say as close as possible to the corresponding dyestuff. However, it is possible to allocate to this latter dyestuff, an additional emulsion layer adjacent to the side of the dyestuff layer opposite from the layer containing the nuclei.

This additional emulsion layer is in that case preferably also free from iodide or can, if desired, also contain a small amount of iodide ions, by means of which the intensity of the desired masking effect can be controlled. Furthermore it is possible to select spectral sensitivities for the emulsions corresponding to the individual dyestuff layers different from the particular complementary colour. Such variants suitable for building up so-called false colour films have been described, for example in Geman Offenlegungsschrift No. 2,132,135.

Silver dye bleach materials for the reproduction of coloured originals are in general trichromatic and contain three colour layers one each in the subtractive main colours yellow, magenta and cyan. However, to achieve special effects, materials with other colours or with only two colour layers can also be used. Normally however there are used as image dyestuffs, the yellow, magenta and cyan dyestuffs which are well known for this purpose, in combination with the appropriate spectral sensitisers.

Light-sensitive silver halide emulsions used are normally those which contain silver chloride, silver bromide or silver iodide or mixtures of these halides. Silver halide emulsions containing iodide normally contain between 0.1 and 10 mol per cent of silver iodide, the remainder consisting of silver chloride and/or silver bromide. To produce these emulsions, gelatine is usually employed as the protective colloid; however it is also possible to use other water-soluble protective colloids, such as polyvinyl alcohol or polyvinylpyrrolidone and the like; furthermore, a part of the gelatine can be replaced by dispersions of high molecular materials which are not water-soluble. For example, it is customary to use dispersion polymers of $\alpha,\beta$-unsaturated compounds such as acrylic acid esters, vinyl esters and vinyl ethers, vinyl chloride, vinylidene chloride and the like, as well as their mixtures and copolymers.

Examples of suitable colloidal nuclei for the deposition of metallic silver from silver complex compounds are colloidal hydrosols of noble metals such as gold, silver or palladium, and also metal sulphides such as nickel sulphide or silver sulphide. Since these nuclei only have to be introduced in very small amounts, for example 1 to 200 mg per $m^2$, in general no interference by light absorption or light scattering will occur. However, it is preferred to introduce into the layer nuclei which can subsequently be removed again, for example during processing. A hydrosol of colloidal silver, which can effortlessly again be removed from the material in the silver bleach process is particularly suitable for this purpose. The yellow silver hydrosol, which can be accommodated directly below the yellow dyestuff layer, in a yellow filter layer intended to absorb the blue irradiation, is particularly suitable.

If metallic silver deposits on the nuclei during development in the presence of an agent which forms a silver complex, it is necessary to ensure that during the subsequent dye bleaching this metallic silver only acts in the desired sense, that is to say on the colour layer which contains the dyestuff together with the iodide-free silver halide emulsion. It is therefore necessary to provide a barrier layer or separating layer from the further colour layers of which the parasitic colour density is to be masked, and to which a silver halide emulsion containing iodide is allocated. Such a separating layer in general consists of pure binder, for example gelatine, and contains neither dyestuff nor silver halide emulsion. Should it be favourable from the point of view of the arrangement or sequence of the layers, an emulsion layer which is already present or a filter layer or the like can also serve as the separating layer. In addition to the gelatine the separating layer can also contain yet further additives such as materials which inhibit dye bleaching, additional binders, such as, for example, water-soluble colloids, or water-insoluble dispersion polymers, as well as the additives customary in building up photographic layers, such as plasticisers, wetting agents, light stabilisers, filter dyestuffs or hardeners.

The exposed silver halide layers are developed, as stated, in the presence of a silver solvent, that is to say of a compound which is capable of forming water-soluble complexes, capable of diffusion, with silver ions. Suitable silver solvents or silver ligands are, for example, the alkali metal salts, such as the sodium salt and potassium salt, or ammonium salts, of thiosulphuric acid, as well as salts of thiocyanic acid. However, sodium thiosulphate is preferred. One litre of developer bath should contain, for example, between 0.05 and 5 g of sodium thiosulphate, and the optimum amount can vary within the stated limits in accordance with the nature of the material, the temperature of the developer bath and the desired period of treatment.

EXAMPLE 1

A photographic material for the silver dye bleach process is produced on a pigmented cellulose acetate carrier, using the cyan image dyestuff of the formula (1)

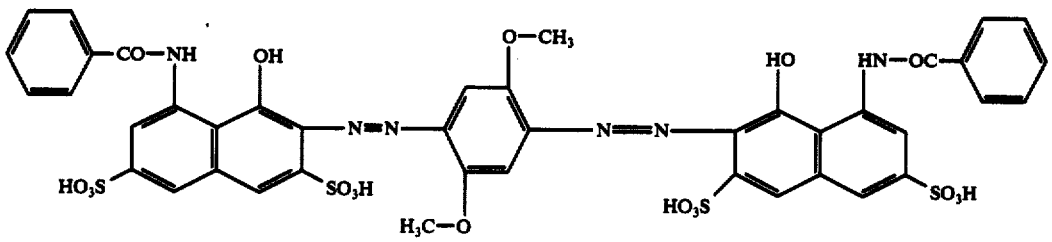

in the red-sensitised bottom layer, the magenta dyestuff of the formula

-continued (2)

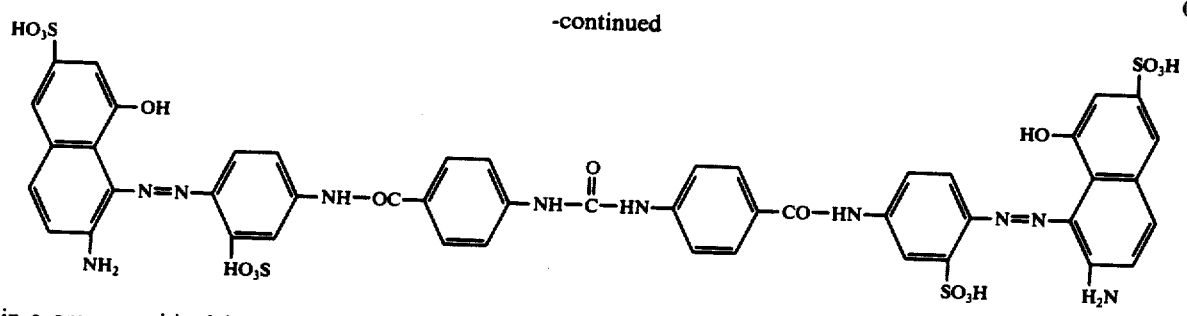

in a green-sensitised layer above this, and the yellow dyestuff of the formula (3)

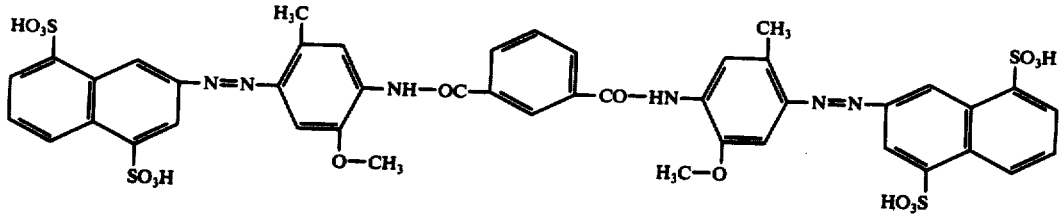

in a blue-sensitive layer above the magenta layer.

The photographic material used is built up as follows (compare West German Patent Publication Nos. 2,036,918 and 2,132,836):

gelatine protective layer
blue-sensitive iodide-free AgBr emulsion
yellow dyestuff (3) + blue-sensitive, iodide-free AgBr emulsion
yellow filter: yellow Ag hydrosol (40 mg/m²)
green-sensitive AgBr/AgI emulsion
magenta dyestuff (2) + green:sensitive AgBr/AgI emulsion
intermediate layer (gelatine)
cyan dyestuff (1) + red-sensitive AgBr/AgI emulsion
red-sensitive AgBr/AgI emulsion
cellulose triacetate carrier, opaque white
backing layer, gelatine The material functions in accordance with scheme (1) of the table (FIG. 2) for correction of the blue parasitic colour densities of the cyan and magenta dyestuffs by additional bleaching of the yellow image dyestuff in dependence on the bleaching of the two other image dyestuffs (iodide-free blue-sensitive layer with yellow dyestuff, remaining colour layers with iodide-containing emulsion). The layer containing the nuclei is adjacent to the yellow dyestuff layer. It additionally contains a yellow light filter dyestuff and is separated from the magenta layer by a colourless emulsion layer (green-sensitive emulsion layer containing AgI, at the same time serving as the separating layer).

The emulsion layers containing iodide contain crystals with 2.6 mol % of silver iodide and 97.4 mol % of silver bromide. The image dyestuffs are used in a concentration such that the reflection density for each layer is 2.0; the total silver content of the material is 2.0 g/m², the overall thickness of the photographic layers being 22μ.

A coloured diapositive is copied onto this material in an enlargement apparatus. The exposed material is processed in accordance with the following instructions U.S. Pat. No. 3,963,492. The processing temperature is 24° C.

| | |
|---|---|
| 1. Silver developer bath | 3 minutes |
| sodium polyphosphate | 1 g/l |
| potassium hydroxide, 85% strength | 27 g/l |
| boric acid | 21 g/l |
| potassium metabisulphite | 18 g/l |
| 1-phenyl-3-pyrazolidone | 0.3 g/l |
| hydroquinone | 5 g/l |
| ascorbic acid | 10 g/l |
| benztriazole | 0.6 g/l |
| potassium bromide | 2 g/l |
| anhydrous sodium thiosulphate | 1.3 g/l |
| 2. Bleach bath | 5 minutes |
| sulphuric acid, 96% strength | 30 ml/l |
| sodium m-nitrobenzenesulphonate | 5 g/l |
| 1-thioglycerol or 3-mercapto-1,2-propanediol | 1 ml/l |
| potassium iodide | 6 g/l |
| catalyst (2,3,6-trimethylquinoxaline) | 2 g/l |
| 3. Rinse | 2 minutes |
| 4. Fixing bath | 4 minutes |
| ammonium thiosulphate | 250 g/l |
| potassium metabisulphite | 50 g/l |
| potassium hydroxide, 85% strength | 20 g/l |
| 5. Rinse | 6 minutes |
| Total processing time | 20 minutes |

The direct-viewing copy of the diapositive, obtained after drying, is distinguished by faithful reproduction of the tonal values and by undistorted colour reproduction. In particular, saturated blue shades of high purity, yellow shades of high saturation and green shades without colour shift towards cyan are reproduced.

For comparison, the same diapositive is exposed a second time onto this photographic material. The exposed material is processed as described, except that the silver developer bath does not contain any sodium thiosulphate. In the copy of the diapositive obtained after drying the reproduction of the colours is comparatively unsatisfactory in respect of saturation and colour shade. The saturated blue shades appear with too high a proportion of yellow, that is to say heavily blackened; yellow shades are insufficiently saturated and green shades contain too little yellow, and are shifted towards cyan.

If the material described in the present Example 1 is treated as stated with a developer bath containing thiosulphate, a slight colour shift towards blue is observed in the dark grey and black image shades, as a consequence of the masking effect. To eliminate this phenomenon, which can under certain circumstances be objectionable with image originals having numerous neutral grey shades, the yellow colour layer of the material can be correspondingly corrected, for example by increasing its reflection density from 2.0 to about 2.4. This causes the colour tinge in the neutral dark grey and black shades to disappear without at the same time significantly impairing the vivid nature of the blue shades. In addition, in this case, the yellow, green and red shades even become more vivid. Quite generally a further increase of the masking effect and an improved colour equilibrium is achieved if the reflection density of the colour layer of which the main colour density corresponds to the parasitic colour density to be corrected, is increased relative to the reflection density of the other colour layers.

EXAMPLE 2

The material used in Example 1 is exposed behind a grey wedge separately with one additive colour filter which is blue, green or red and, in one case, with all three filters (blue + green + red). The exposure times are so selected that in the case of the superposition (blue + green + red) a grey wedge which is as neutral as possible is produced after processing. Thereafter the material is processed in accordance with the following instructions (Swiss Patent Application No. 14,531, TEL 144). The processing temperature is 24° C.

| | |
|---|---|
| 1. Silver developer bath | 3 minutes |
| as in Example 1 | |
| 2. Bleach bath | 5 minutes |
| sulphuric acid, 96% strength | 14 ml/l |
| sodium m-nitrobenzenesulphonate | 4 g/l |
| 1-thioglycerol | 1 ml/l |
| potassium iodide | 6 g/l |
| catalyst: 2,3,6-trimethyl-quinoxaline | 2 g/l |
| 3. Rinse | 2 minutes |
| 4. Fixing bath | 4 minutes |
| as in Example 1 | |
| 5. Rinse | 6 minutes |
| total processing time | 20 minutes |

Figures 3, 4, 5:
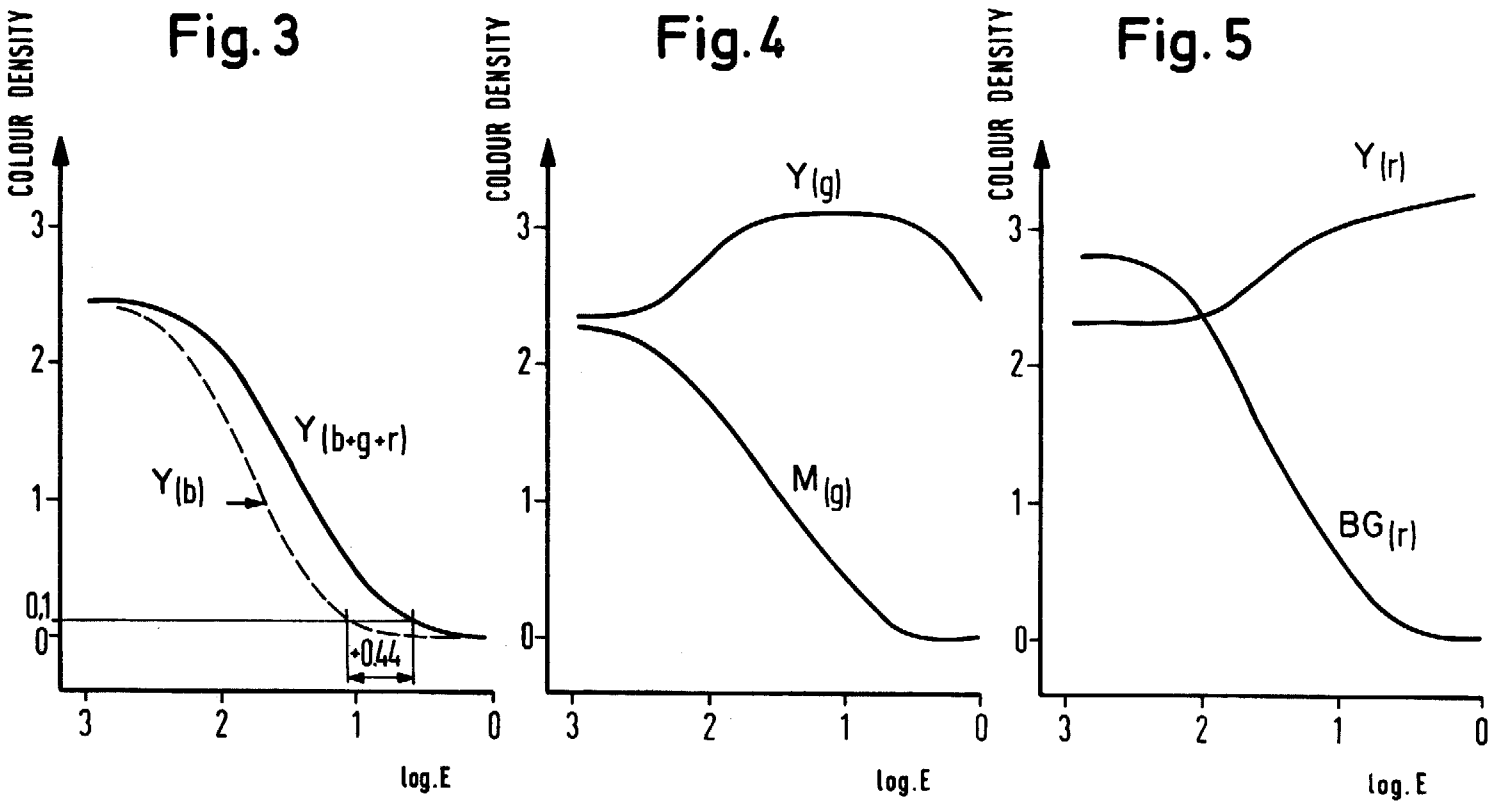
FIGS. 3 to 5 illustrate the four (blue, green, red and gray) wedges after drying.

The four wedges (blue (b), green (g) and red (r) wedge and grey wedge) obtained after drying are evaluated by analytical sensitometry. The results are shown in FIGS. 3 to 5. It can be seen from FIGS. 4 and 5 that with increasing green exposure and red exposure (= decreasing magenta (m) and cyan (bluegreen-(bg) density) the yellow density increases. This results in a lower sensitivity of the yellow layer on grey exposure y (b+g+r) as compared to the yellow layer on blue exposure alone (FIG. 3, y (b)). The masking effect, expressed as the sensitivity difference log E for a colour density of 0.1, is $\log E_{y(b+g+r)} - \log E_{y(b)} = +0.44$.

Similar results are obtained if a material is used which contains an emulsion of 2 mol % of silver iodide and 98 mol % of silver bromide in the layer above the yellow dyestuff layer.

EXAMPLE 3

Figure 2:
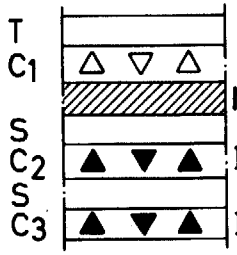
FIG. 2 illustrates the manner in which the material functions with the blue parasitic color developer.
Figure 2:
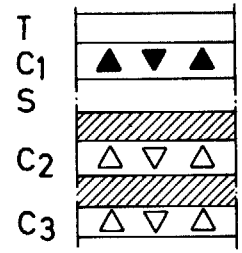
Figure 2:
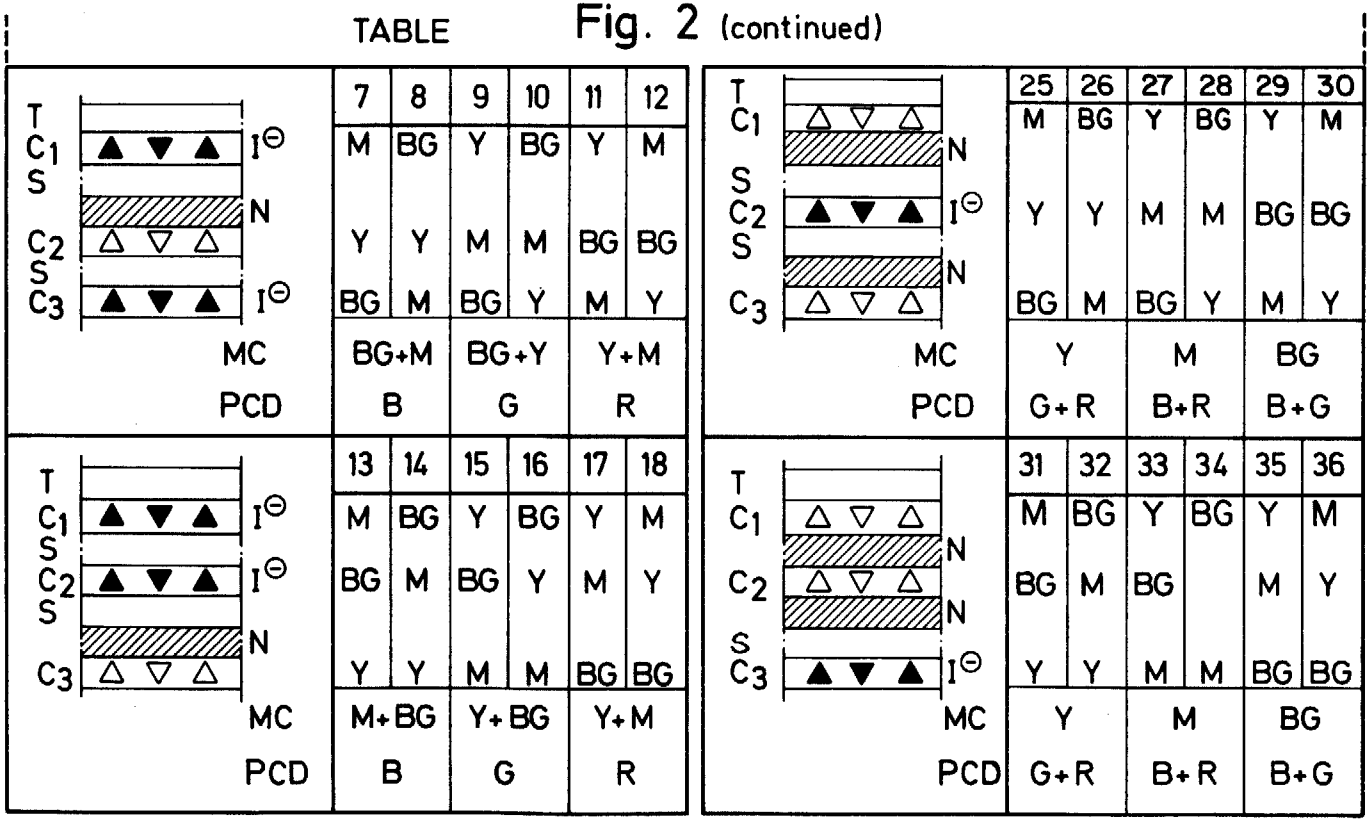

A photographic material for the silver dye bleach process, which contains the same image dyestuffs as in Example 1, is produced on a transparent polyester carrier. However, the material exhibits the following sequence of layers (compare also German Patent Publication No. 2,036,918 and DT-OS No. 2,132,835).

gelatine protective layer
blue-sensitive, iodide-free AgBr emulsion
yellow dyestuff (3) + blue-sensitive iodide-free AgBr emulsion
yellow silver hydrosol (40 mg/m²)
green-sensitive AgBr/AgI emulsion
magenta dyestuff (2) + green-sensitive AgBr/AgI emulsion
green-sensitive AgBr/AgI emulsion
yellow silver hydrosol (40 mg/m²)
cyan dyestuff (1) + red-sensitive iodide-free AgBr emulsion
transparent polyester carrier
gelatine back layer The material functions in accordance with scheme 27 of the table (FIG. 2). It corrects the blue and red colour density of the magenta dyestuff (blue-sensitive layer with yellow dyestuff and red-sensitive layer with cyan dyestuff, iodide-free, green-sensitive layers with emulsion containing iodide). The layers containing nuclei are adjacent to the yellow and to the cyan dyestuff layer and are separated from the magenta layer in each case by a colourless emulsion layer containing silver iodide. The emulsion layers containing iodide contain crystals with 5 mol % of silver iodide and 95 mol % of silver bromide. The dyestuffs are cast at concentrations such that after processing the material has a neutral maximum transmission density of 2.8. The silver content of all layers containing emulsions together amounts to 3.9 g/m².

This material is exposed in contact with a coloured diapositive and is then processed in accordance with the following instructions at a temperature of 24° C.

| | |
|---|---|
| 1. Silver developer bath | 5 minutes |
| tetrasodium salt of ethylenediamine-tetraacetic acid | 2 g/l |
| potassium carbonate | 36 g/l |
| anhydrous sodium sulphite | 11 g/l |
| potassium metabisulphite | 18 g/l |
| 1-phenyl-3-pyrazolidone | 0.25 g/l |
| hydroquinone | 6 g/l |
| potassium bromide | 2 g/l |
| benzatriazole | 0.5 g/l |
| ammonium thiosulphate | 0.5 g/l |
| 2. Rinse | 5 minutes |
| 3. Dye bleach bath | 7 minutes |
| sulphamic acid | 80 g/l |
| thioglycerol | 1.5 ml/l |
| potassium iodide | 30 g/l |
| catalyst (2,3-dimethyl-5-amino-6-methoxy-quinoxaline) | 100 mg/l |
| 4. Rinse | 1 minute |
| 5. Silver bleaching | 3 minutes |
| potassium ferricyanide | 60 g/l |
| potassium bromide | 12 g/l |
| sodium acetate · $3H_2O$ | 5 g/l |
| acetic acid, 98% strength | 10 ml/l |
| 6. Rinse | 2 minutes |
| 7. Fixing bath | 8 minutes |
| (as Example 1) | |
| 9. Rinse | 6 minutes |
| total processing time | 37 minutes |

After drying, an excellent transparent duplicate of the original diapositive is obtained. In addition to the correct gradation of the tonal values, the colour shades are reproduced in undistorted purity. In particular, their highly saturated blue, yellow and red shades are equivalent, in colour shade and saturation, to the original.

What we claim is:

1. Process for the production of masked subtractive positive colour images in accordance with the silver dye bleach process, by exposure, silver development, dye bleaching, silver bleaching and fixing, using a photographic material which contains, in each of at least two layers, a dyestuff which can be bleached imagewise, and of which the absorption maximum corresponds to one of the primary colours red, green and blue, with a silver halide emulsion layer sensitive to a particular spectral region being allocated to each dyestuff, which process comprises employing a photographic material in which a. a silver halide emulsion layer consisting at least partially of silver iodide is allocated to the dyestuff, of which the undesired parasitic colour density is to be compensated, b. in a further layer, at least one second dyestuff, of which the main colour density corresponds to a parasitic colour density, requiring compensation, of the first dyestuff, and a silver halide emulsion free from iodide ions, are present, c. a further layer, which is adjacent to that containing the second dyestuff, contains colloidal nuclei which are capable of depositing metallic silver from soluble silver complexes, d. a separating layer is present between the layer containing the nuclei and the dyestuff layer, of which the parasitic colour density is to be compensated, and which process also comprises employing a silver devolper bath containing a ligand, which is able to produce water-soluble silver complexes which are capable of diffusion.

2. Process according to claim 1, wherein the spectral sensitivity of the silver halide emulsions coincides with the main absorption maximum of the image dyestuff to which they are allocated.

3. Process according claim 1, wherein the spectral sensitivity of the silver halide emulsions lies in a spectral region different from the main absorption maximum of the image dyestuff to which they are allocated.

4. Process according to claim 1, wherein the photographic material contains additional layers which contain neither image dyestuff nor silver halide.

5. Process according to claim 1, wherein a trichromatic material is used which contains, in one layer each, a cyan dyestuff, a magenta dyestuff and a yellow dyestuff as the image dyestuffs.

6. Process according to claim 5, wherein the silver halide emulsions allocated to the individual image dyestuffs are present in the same layer as the corresponding image dyestuffs.

7. Process according to claim 5, wherein the silver halide emulsions allocated to the individual dyestuffs are present at least partially in a layer adjoining the dyestuff layer.

8. Process according to claim 1, wherein (a) one image dyestuff of a multi-layer material compensates one parasitic colour density, or (b) one image dyestuff of a multi-layer material compensates two parasitic colour densities, or (c) two image dyestuffs of a multi-layer material each compensate one parasitic colour density.

9. Process according to claim 1, wherein the emulsion layers free from silver iodide contain silver chloride or silver bromide or a mixture of both halides.

10. Process according to claim 1, wherein the nuclei capable of depositing metallic silver consist of colloidal silver.

11. Process according to claim 10, wherein the nuclei capable of depositing metallic silver are present in the form of a yellow silver sol in a yellow filter layer.

12. Process according to claim 1, wherein the silver ligand used in developing is the thiosulphate ion and between 0.05 and 5 g of sodium thiosulphate or ammonium thiosulphate are used per liter of developer bath.

13. Silver dye bleach material suitable for carrying out the process according to claim 1, which comprises, in each of at least two layers, a dyestuff which can be bleached imagewise, and of which the absorption maximum corresponds to one of the primary colours red, green and blue, with a silver halide emulsion layer sensitive to a particular sprectral region being allocated to each dyestuff, and in this material a. a silver halide emulsion layer consisting at least partially of silver iodide is allocated to the dyestuff, of which the undesired parasitic colour density is to be compensated, b. in a further layer, at least one second dyestuff, of which the main colour density corresponds to a parasitic colour density, requiring compensation, of the first dyestuff, and a silver halide emulsion free from iodide ions, are present, c. a further layer, which is adjacent to that containing the second dyestuff, contains colloidal nuclei which are capable of depositing metallic silver from soluble silver complexes, d. a separating layer is present between the layer containing the nuclei and the dyestuff layer, of which the parasitic colour density is to be compensated.

14. Silver dye bleach material according to claim 13, wherein the optical density of at least one image dyestuff layer, of which the main colour density corresponds to the parasitic colour density to be compensated, is increased by an amount which compensates the density loss after processing in the unexposed state.

* * * * *